United States Patent [19]

Brandt

[11] Patent Number: 4,672,987

[45] Date of Patent: Jun. 16, 1987

[54] DEVICE FOR CLEANING PAINT ROLLERS

[76] Inventor: Lloyd W. Brandt, 2303 E. Flower St., Phoenix, Ariz. 85016

[21] Appl. No.: 735,999

[22] Filed: May 20, 1985

[51] Int. Cl.[4] ..... B08B 3/02

[52] U.S. Cl. ..... 134/138; 134/143; 134/149

[58] Field of Search ..... 134/51, 137, 138, 139, 134/143, 149; 68/213; 34/58

[56] References Cited

U.S. PATENT DOCUMENTS

| | | | |
|---|---|---|---|
| 2,741,857 | 4/1956 | Linatsas | 134/149 X |
| 2,773,274 | 12/1956 | Beech | 134/149 X |
| 2,831,488 | 4/1958 | Anderson | 134/138 |
| 2,938,368 | 5/1960 | Bixel | 134/149 X |
| 3,075,534 | 1/1963 | Habostad | 134/138 |
| 3,133,548 | 5/1964 | Carr | 134/138 |
| 3,428,060 | 2/1969 | Spivey | 134/141 |
| 3,587,599 | 6/1971 | Bywater | 134/138 |
| 3,818,529 | 6/1974 | Leggett | 134/138 X |
| 3,873,364 | 3/1975 | Smith | 134/138 |
| 3,886,960 | 6/1975 | Krueger | 134/138 |
| 3,897,797 | 8/1975 | Wright et al. | 134/113 |
| 4,061,153 | 12/1977 | Doherty | 134/138 |
| 4,402,333 | 9/1983 | Frizzell et al. | 134/138 |

FOREIGN PATENT DOCUMENTS

| | | | |
|---|---|---|---|
| 2360884 | 6/1975 | Fed. Rep. of Germany | 134/138 |
| 2716931 | 10/1978 | Fed. Rep. of Germany | 134/138 |

*Primary Examiner*—Harvey C. Hornsby
*Assistant Examiner*—Frankie L. Stinson
*Attorney, Agent, or Firm*—Kinney & Lange

[57] ABSTRACT

The present invention is a device for cleaning a roller of a paint roller applicator, while the roller is secured to a handle of the roller applicator. The cleaning device includes a vertically oriented tubular housing having an open top through which the roller is inserted into the housing for washing, and having an open bottom through which used washing fluid and material exit the housing. A sprayer assembly is provided for directing a stream of washing fluid against the roller when disposed within the housing to clean and rotate the roller on the handle. A cap for closing the top of the housing, is arranged to support the roller applicator so that the roller extends within the housing for washing. The cap has a laterally opening slot through which the handle extends when the roller is disposed within the housing. The cap is further arranged to adjustably fix the position of the handle of the roller applicator to align the roller with the fluid stream.

8 Claims, 7 Drawing Figures

Fig. 2
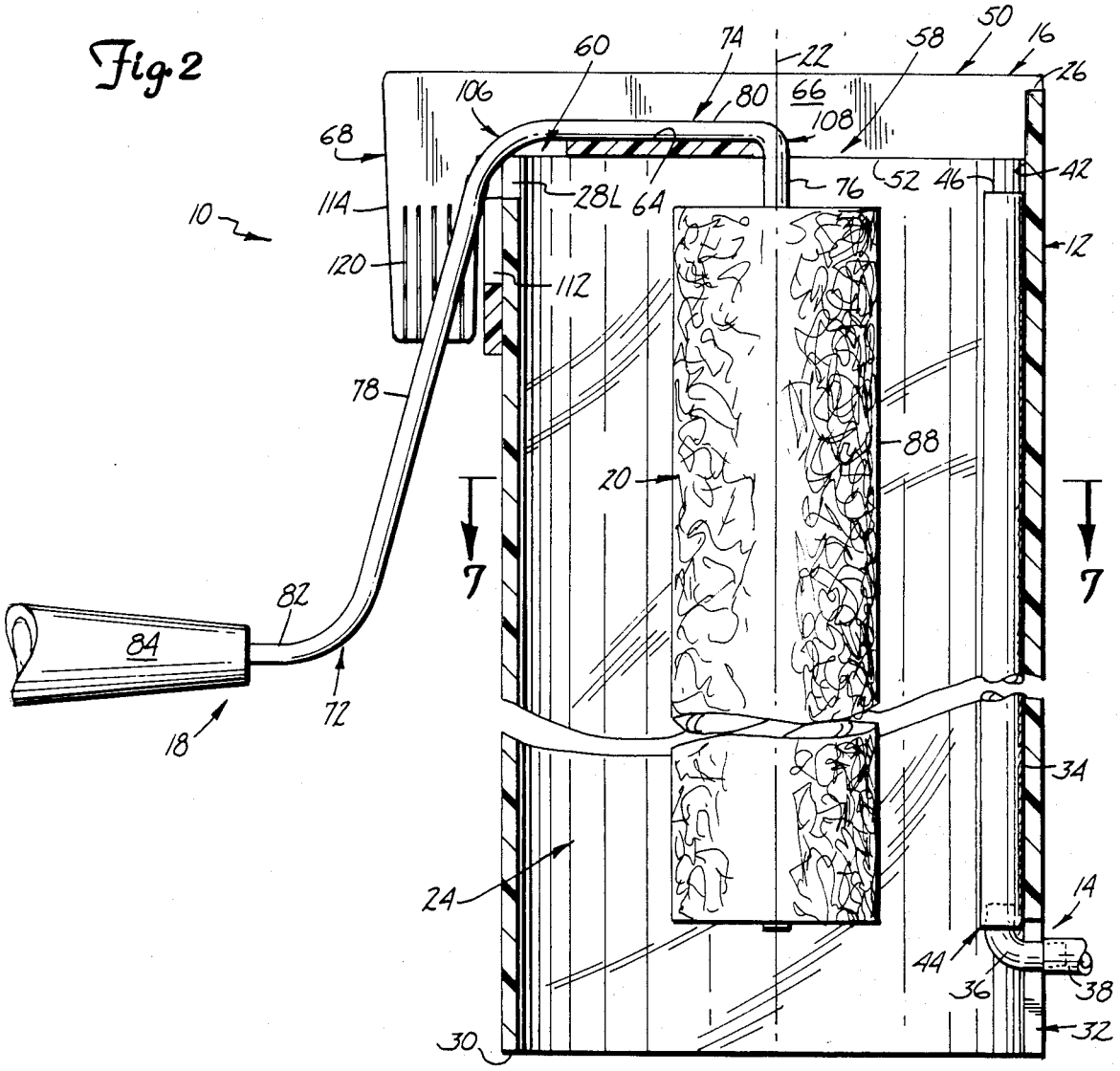
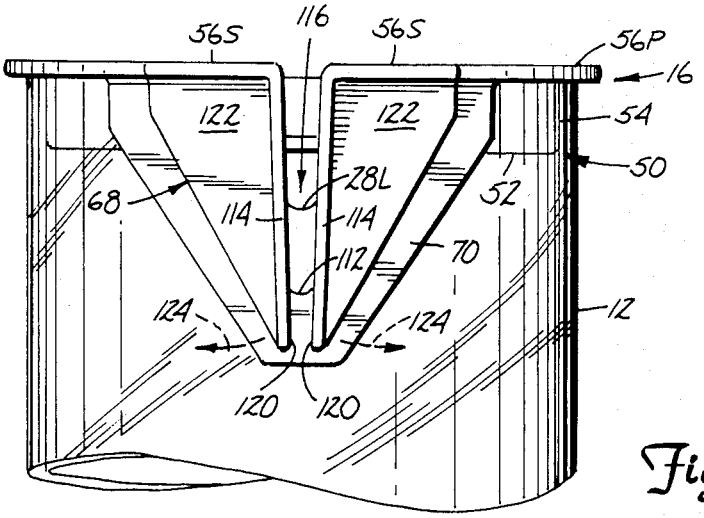
Fig. 4

DEVICE FOR CLEANING PAINT ROLLERS

BACKGROUND OF THE INVENTION

1. Field of the Invention

The present invention relates generally to apparatus used to clean roller covers of paint roller applicators, and particularly to an apparatus for washing a paint roller cover while it is attached to the paint roller applicator.

2. Description of the Prior Art

Various apparatus have been used for washing roller covers of paint roller applicators. These apparatus typically include a housing in which the roller cover is mounted for washing, and means carried by the housing for directing a stream of washing fluid at the roller cover.

U.S. Pat. Nos. 2,831,488 to Anderson, 3,428,060 to Spivey and 3,873,364 to Smith are representative of such washing apparatus. However, these patents describe washing apparatus which require that the roller cover be removed from the paint roller applicator and mounted on a roller support within the housing. This is time consuming and inconvenient, particularly when the roller is wet with paint.

U.S. Pat. No. 4,061,153 to Doherty describes a washing apparatus arranged to wash the roller cover while it is mounted on the roller applicator. The apparatus includes a housing having an opening through a first side wall which is closed by a cap secured to a housing by screws. A second side wall of the housing is also arranged with an opening dimensioned to receive a first end of a roller frame on which the roller cover is mounted. To mount the roller cover within the housing for washing, it is necessary to remove the cap, position the roller within the housing with the first end of the roller frame disposed within the opening in the second wall, and replace the cap. This process is time consuming and inconvenient.

U.S. Pat. No. 3,886,960 to Krueger discloses a paint roller cleaning apparatus which includes a hollow casing open at the top, and having a slot along its length allowing the roller to be inserted within the casing with the handle protruding through the slot. A grooved track is defined at the bottom of the hollow casing for holding the paint roller applicator in place while allowing the applicator to be slid back and forth through a stream of water for washing. If the upward facing grooved track is not continually cleaned, it may become clogged by foreign material washed from the roller.

U.S. Pat. No. 3,897,797 to Wright et al. describes the use of a bracket including two plates secured together in face to face relation by screw fasteners, which engage an handle of a paint roller applicator therebetween. The bracket is arranged to be mounted on a wall of the housing to support a roller of the paint roller applicator within the housing. It is time consuming to mount the bracket onto the handle of the roller applicator, and the bracket must be removed and secured to other applicators as they are placed in service.

U.S. Pat. No. 3,075,534 to Habostad discloses a paint roller cleaner which includes a cylindrical housing having an opening defined through a top wall of the housing through which the roller is inserted into the housing for washing. The top wall of the housing further includes a notch through which the handle of the roller applicator protrudes from the housing. Attached to the cylindrical housing are clips for engaging a portion of the handle of the roller applicator to fix the position of the roller within the housing. Adjustment of the position of the roller within the housing is not possible with this arrangement.

SUMMARY OF THE INVENTION

The present invention is a device for cleaning a roller of a paint roller applicator, while the roller is secured to a handle of the roller applicator. The cleaning device includes a vertically oriented tubular housing having an open top through which the roller is inserted into the housing for washing, and having an open bottom through which used washing fluid and material exit the housing. A sprayer assembly is provided for directing a stream of washing fluid against the roller when disposed within the housing, to clean and rotate the roller on the handle. A cap for closing the top of the housing is arranged to support the roller applicator so that the roller extends within the housing for washing. The cap has a laterally opening slot through which the handle extends when the roller is disposed within the housing. The cap further includes means for adjustably fixing the position of the handle of the roller applicator to align the roller with the fluid stream.

BRIEF DESCRIPTION OF THE DRAWINGS

FIG. 2 is a cross sectional view of the roller cleaning device of the present invention, taken along the line 2—2 of FIG. 1, illustrating the disposition of the paint roller applicator when mounted on the cover of the washing device for washing;

FIG. 4 is a side view of the cover of the washing device mounted on the housing (partially shown) of the present invention;

DETAILED DESCRIPTION OF THE PREFERRED EMBODIMENTS

Figure 1:
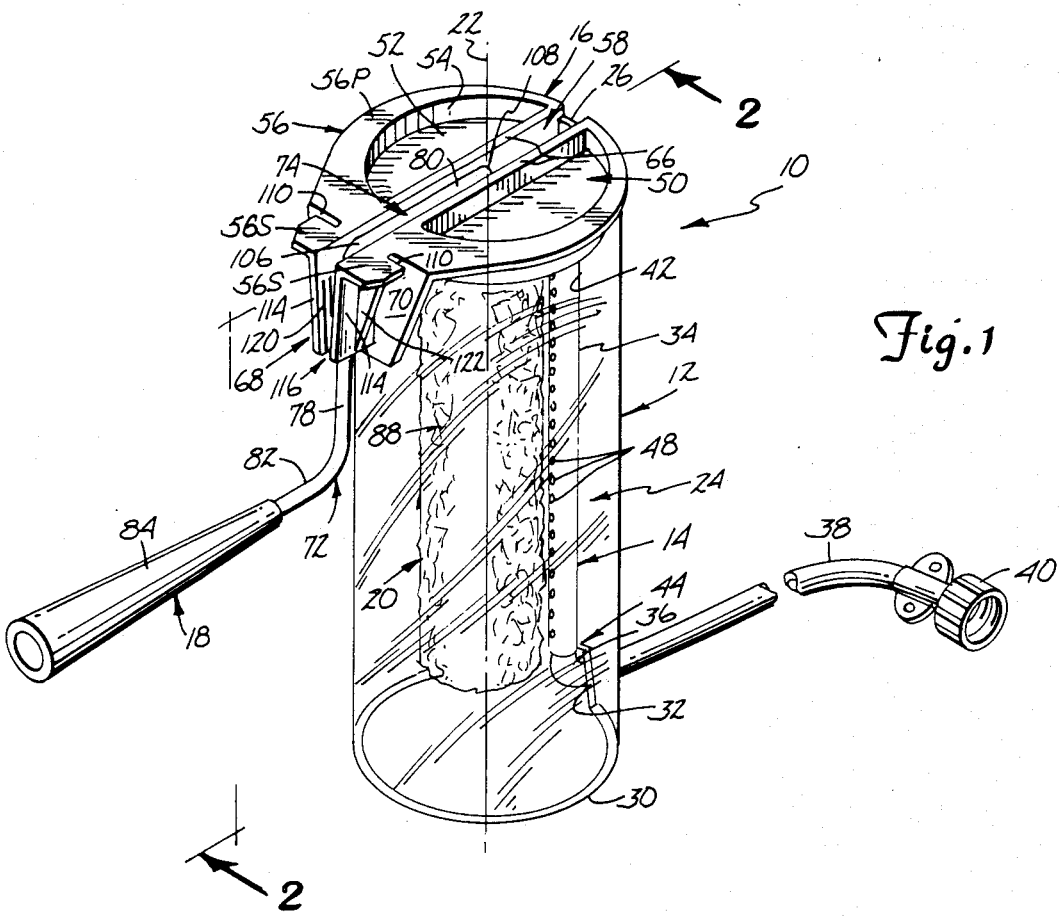
FIG. 1 is a perspective view of the roller cleaning device of the present invention, which includes a housing defining a washing chamber accessible through an opening in the top of the housing, and a cover closing the opening in the top of the housing, illustrating a roller applicator having a roller mounted on the cover with the roller supported within the washing chamber of the housing for washing.

As shown in the perspective view of FIG. 1, a paint roller cleaner 10 of the present invention has three major parts, a tubular housing 12, a sprayer assembly 14, and a cap or cover 16. The cap or cover 16 closes the top end of the tubular housing 12 and supports a roller applicator 18 such that a roller 20 of the applicator 18 extends into the housing 12 for washing. The sprayer assembly 14 directs a generally planar stream of washing fluid (such as water) against the roller 20 to clean and rotate the roller 20 within the housing 12.

The tubular housing 12 is vertically oriented along a vertical axis 22, defines a washing chamber 24, and has an open top and an open bottom. The wall of the housing 12 has an upper edge 26 having an upwardly facing positioning notch 28 (illustrated in FIG. 5) and a bottom edge 30 having a second downwardly facing notch 32.

The sprayer assembly 14 includes a spray tube 34, an elbow 36, and a flexible hose 38 carrying a threaded female fitting 40 at one end. The spray tube 34 is adhesively secured to an inner surface 42 of the housing 12, and is connected at a first (lower) end 44 to the elbow 36. A portion of the elbow 36 extends through the second notch 32 in the wall of the housing 12 and is connected to the flexible hose 38. The hose 38 is connected by the threaded fitting 40 to an external pressurized source of washing fluid (not shown), typically a water supply. The spray tube 34 is closed at a second (upper) end 46 (FIG. 2), and includes a plurality of openings 48 spaced along its length in substantially parallel alignment with the vertical axis 22 of the housing 12.

Figure 3:
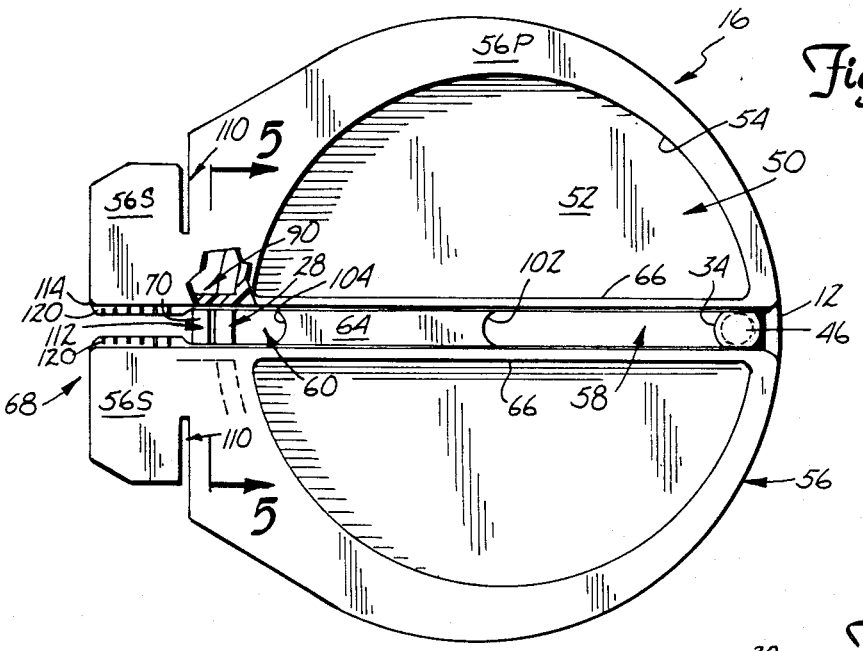
FIG. 3 is a top plan view of the cover of the present invention with a portion cut away to show a "neck" portion of the cover.

The cover 16 includes a shallow cup 50 having a bottom wall 52, an annular side wall 54 and a brim 56. As shown in FIG. 3, the bottom wall 52 includes first and second diametrically aligned, laterally opening slots 58 and 60, respectively, defining a support surface 64 therebetween. The cover 16 further includes a first pair of flanges 66, a second pair of flanges 68 and a shield 70. The first pair of flanges 66 are parallel and extend upwardly from the bottom wall 52 of the cup 50 on either side of the slots 58 and 60. The second pair of flanges 68 extends substantially vertically downward from one side of the cup 50, in alignment with slot 60. Shield 70 extends downward from a position near the open end of slot 60.

Figure 6:
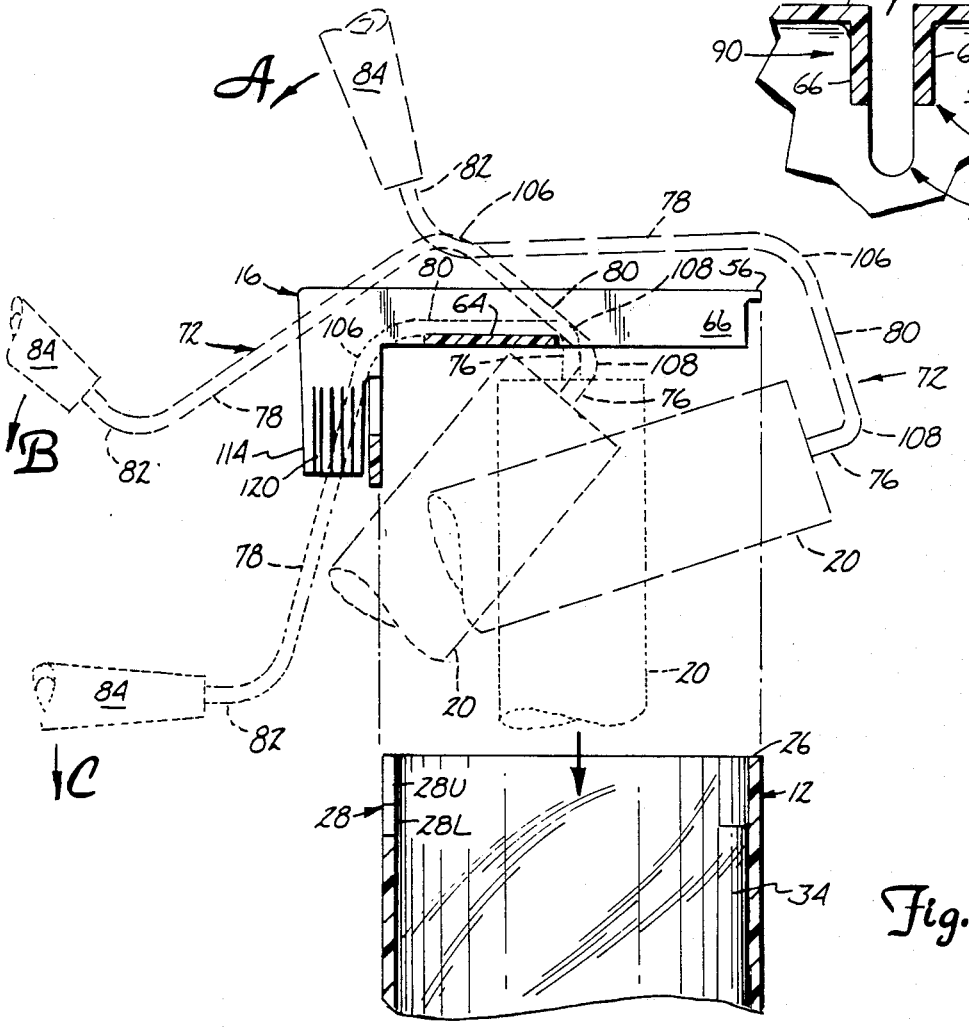
FIG. 6 is an exploded cross sectional view of the cover and an upper portion of the housing of the present invention, illustrating how the roller applicator is mounted on the cover and positioned for washing within the housing.

The paint roller cleaner 10 of the present invention is arranged to clean the rollers of standard hand roller applicators of the type indicated in FIGS. 1, 2 and 6. As illustrated in FIG. 2, these roller applicators 18 include a bent rod roller frame 72 having a U-shaped portion 74 which includes first and second generally parallel legs 76 and 78, respectively, integrally connected by a base leg 80. A fourth leg 82 extends from the second leg 78 in substantially perpendicular alignment therewith, and supports a handle 84. Rotatably mounted on the first leg 76 is a roller frame cage 86 (FIG. 7) which supports a roller cover 88. The roller 20 is actually a combination of the roller cover 88 mounted on the roller frame cage 86.

Figure 5:
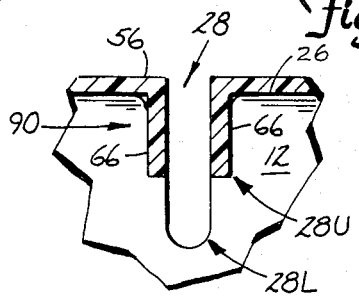
FIG. 5 is a sectional view of a portion of the cover and the housing of the present invention, taken along the line 5—5 in FIG. 3.

The cover 16 is arranged to close the top of the housing 12 as shown in FIGS. 2, 4 and 6. The shallow cup 50 is received within the washing chamber 24 of the housing 12 and is supported on the top edge 26 of the housing wall by the brim 56 of the cover 16. A "neck" portion 90 (as shown in FIG. 3) of the first flanges 66, adjacent the second flanges 68 and the shield 70, mates with a wider, upper portion 28U of the positioning notch 28, (as shown in FIG. 5), to fix the position of the cover 16 with respect to the housing 12, and particularly with respect to the spray tube 34.

The cover 16 is further arranged to support the roller paint applicator 18 so that the roller 20 substantially coaxially extends into the washing chamber 24 of the housing 12. The manner in which the roller applicator 20 is mounted on the cover 16 is generally indicated in FIG. 6. First, the cover 16 is removed from the top of the housing 12, and the roller applicator 18 is positioned as shown at A. The base leg 80 of the applicator roller frame 72 is aligned to be received within the first laterally opening slot 58. The roller frame 72 is drawn through the first laterally opening slot 58 until the first leg 76 is disposed substantially adjacent the center of the cover 16, as shown at B. The roller frame 72 is then rotated to its final position shown at C, with the roller 20 substantially coaxially aligned with the housing 12. In this "saddled" or supported position, the roller 20 extends below the bottom wall 52 of the cover 16; the base leg 80 is supported on the support surface 64, between the first pair of flanges 66; and the second leg 78 is disposed between and grasped by the second pair of flanges 68. After the roller applicator 18 has been mounted on the cover 16, the cover 16 is repositioned on the top of the tubular housing 12 as indicated, with the roller 20 disposed within the washing chamber 24 of the housing 12 for washing.

Figure 7:
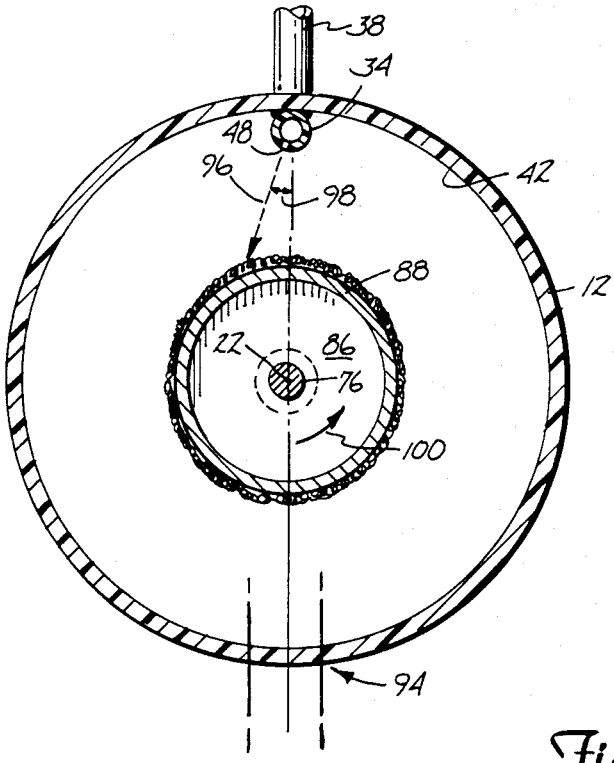
FIG. 7 is a sectional view of the washing device of the present invention, taken along the line 7—7 in FIG. 2.

As shown in FIG. 7, the positioning notch 28 mates with the neck portion 90 of the first flanges 66 to fix the position of the cover 16, and particularly the roller 20 carried by the cover 16, at the same angular orientation with respect to the spray tube 34 each time. The relative location of the positioning notch 28 with respect to the spray tube 34 is indicated by the phantom lines at 94, diametrically aligned with the spray tube 34. When the sprayer assembly is connected to an external washing fluid source, such as a water faucet, water is directed through the openings 48 in the spray tube 34 to define a substantially vertically planar fluid stream 96 which strikes the roller 20 along its length at a predetermined angle with respect to the roller axis (vertical axis 22), as indicated at 98. The action of the fluid stream 96 against the roller 20 dislodges paint and other foreign material from the roller 20. The roller 20 is also rotated about its axis (coaxially aligned with the vertical axis 22) so that it rotates in a direction indicated at 100 to further enhance dislodgement of the paint and other foreign material by centrifugal force.

The tubular housing 12 and the spray tube 34 are preferably constructed of a clear, rigid plastic so that the washing process may be observed. The housing 12 is arranged to be supported by its bottom edge 30 over a drain (not shown) when washing the roller 20, so that used washing fluid and paint flow directly through the open bottom of the housing 12 into the drain. However, used washing fluid and paint can drain from the housing through the second notch 32 defined by the bottom edge 30 of the housing 12, if the paint roller cleaner 10 is to be supported on a flat surface.

The cover 16 is preferably integrally molded of plastic for reduced cost. The slots 58 and 60 are defined through the bottom wall 52 and the side wall 54 of the cup 50, the first slot 58 extending to the center of the cover 16. As shown in FIG. 3, the bottom wall 52 defines arcuate or curved inner edges 102 and 104 of the first slot 58 and second slot 60, respectively. The inner edges 102 and 104 are spaced from each other to engage a first bend 106 and a second bend 108 adjacent each end of the base leg 80 of roller frame 72, so that the support surface 64 is located between the first leg 76 and the second leg 78. The upward extending first pair of flanges 66 laterally support and retain the base leg 80 on the support surface 64.

The brim 56 includes opposing slots 110 which divide the brim 56 into a first portion 56P which extends around the perimeter of the cup 50 and second portions (or ears) 56S which are disposed along one side of the cup 50 and support the second flanges 68. The shield 70 extends downward from the first portion 56P, adjacent the opposing slots 110 and the "neck" portion 90 of the first flanges 66, and includes an upward facing slot 112 in communication with the second laterally opening slot 60.

The second flanges 68 include a pair of spaced apart plates 114, each extending downward from one of the second portions 56S of the brim 56. The parallel plates 114 define a gap 116 therebetween for receiving the second leg 78 of the roller frame 72. The plates 114 converge as they extend downwardly so that the gap 116 between them narrows toward their bottom ends. The narrowest gap adjacent the bottom end of the vertical plates 114 is slightly closer together than the thickness of the roller frame 72, so that the second pair of flanges 68 tightly, yet adjustably grasp the second leg 78 therebetween. Inward facing surfaces 120 of the plates 114 are preferably serrated or roughened to enhance the grip the second flanges 68 have on the roller frame 72.

The second flanges 68 further include cross braces 122 extending between a bottom surface of the ears 56S of the brim 56, and the plates 114, so that the plates 114 are substantially rigidly carried by ears 56S. However, the opposing slots 110 defined through the brim 56 permit some outward flexing of the lower ends of the flanges 68 carried by the ears 56S as indicated by arrows 124 in FIG. 4. It should be noted that the lower ends of plates 114 are spaced from shield 70, as best shown in FIGS. 2 and 6, and therefore are free to flex outward to the extent permitted by ears 56S when leg 78 of the roller frame 72 is inserted between plates 114. The resiliency of the ears 56S, however, resists outward movement of the lower ends of plates 114 and applies a bias force in directions opposite to arrows 124. This arrangement, therefore, permits the second leg 78 to be grasped securely between the inwardly biased plates 114 of second flanges 68, so that the roller 20 can be coaxially aligned with the tubular housing 12.

The shield 70 prevents the roller frame 72 from engaging, and thus damaging the wall of the tubular housing 12, and further retains the roller frame 72 within the grasp of the second flanges 68. Also, the shield 70 acts on the first leg 76 to bias the second bend 108 of the roller frame 72 into engagement with the curved inner edge 102 of the first slot 58, so that the roller applicator 18 is snugly mounted on the cover 16.

The alignment of the second laterally opening slot 60, the upward facing slot 112 of the shield 70, the positioning notch 28 of the housing 12, and the gap 116 between the plates 114 of the second flanges 68, when the cover 16 is in closing relationship with the housing 12, permits the paint roller cleaner 10 to be used with roller applicators having first and second legs which are not disposed in parallel alignment, as illustrated in FIG. 2. The positioning notch 28 includes both an upper portion 28U dimensioned to mate with the neck 90 of the first flanges 66, and a lower portion 28L through which the roller frame 72 is free to extend.

The present invention offers several advantages over prior art apparatus. First, the roller applicator 18 is readily mounted on the cover 16, and supported within the tubular housing 12 for washing, without having to remove the roller cover 88 from the roller applicator 18. Secondly, the cover 16 is securely mounted on the top of the housing 12 without the need of fasteners, making it more convenient to remove and replace. The weight of the roller 20, supported at the center 62 of the cover 16, retains the cover 16 in place on the housing 12 with the aid of gravity.

The first and second laterally opening slots 58 and 60 permit the cover 16 to be used with roller applicators 18 having their first and second legs disposed at angles other than 90°, with respect to the base leg. Further, the first flanges 66 provide lateral support of the roller frame 72 when mounted on the cover 16, and the second flanges 68 (and ears 56S) flex outward to permit adjustment of the alignment of the roller 20 with the fluid stream 96 so that the fluid stream 96 strikes the roller 20 substantially at a right angle along its length.

Engagement of the neck portion 90 of the first flanges 66 with the upper positioning notch 28 ensures the same angular orientation of the roller 20 with respect to the fluid stream 96 each time a roller applicator is mounted on the cover 16 and disposed within the housing 12 for washing. Also, the molded plastic construction of the housing 12 and cover 16 reduces the cost of construction.

Although the present invention has been described with reference to preferred embodiments, workers skilled in the art will recognize that changes may be made in form and detail without departing from the spirit and scope of the invention.

What is claimed is:

1. A device for cleaning a roller of a paint roller applicator, while the roller is rotatably mounted on a roller frame of the roller applicator, the cleaning device comprising:

a vertically oriented tubular housing having an open top through which the roller is inserted into the housing for washing and having an open bottom through which used washing fluid and material drain from the housing;

a sprayer assembly including a spray tube secured to an inner wall of the housing for directing a stream of washing fluid against the roller when the roller is disposed within the housing, to clean and rotate the roller on the roller frame; and a cap for closing the top of the housing, the cap being further arranged to support the roller applicator such that the roller extends into the housing for washing, the cap having a first laterally opening slot through which a portion of the roller frame extends when the roller is disposed within the housing, and further having means for adjustably fixing the position of the roller frame with respect to the cap to orient the roller in a predetermined alignment with the fluid stream, wherein the means for adjustably fixing includes a first pair of spaced flanges extending downward from one side of the cap, the flanges being resiliently connected to the cap so that a gap between them narrows toward a bottom end of the flanges, a narrowest portion of the gap adjacent the bottom end being slightly closer together than a thickness of the roller frame of the roller applicator such that the first part of flanges move apart to receive and are resiliently biased toward one another to tightly grasp a first portion of the roller frame therebetween, wherein the first pair of flanges have serrated inward facing surfaces to enhance gripping of the roller frame by the first pair of flanges, wherein the cap further includes a second pair of substantially parallel flanges extending upward from an upward facing surface of the cap, to support a second portion of the roller frame on the upward facing surface of the cap, the second pair of flanges being disposed on either side of the first slot.

2. The cleaning device of claim 1 wherein a top edge of a wall of the tubular housing defines an upwardly facing positioning notch, and a portion of the second pair of flanges are arranged to mate with with the positioning notch to fix the position of the cap with respect to the housing, so that the fluid stream is directed at the roller at a predetermined angle with respect to an axis of rotation of the roller.

3. The cleaning device of claim 2 wherein the cap further includes a second laterally opening slot, diametrically aligned with and oppositely facing the first laterally opening slot, which second slot communicates with the gap between the first pair of flanges and is arranged to receive a third portion of the roller frame, intermediate the first and second portions.

4. The cleaning device of claim 3 wherein the means for adjustably fixing further includes a plate carried by and extending downward from one side of the cap, adjacent and perpendicularly aligned with the first pair of flanges.

5. A roller washing device for roller applicators of the type having a roller frame with a U-shaped portion defining first and second legs connected by a base leg, and a roller rotatably mounted on the first leg, the roller washing device comprising:

a vertically oriented tubular housing having an open top through which the roller is inserted into the housing for washing and having an open bottom through which used washing fluid and material drain from the housing;

a spray tube plugged at a first end and arranged with a plurality of jet nozzles spaced along its length, the spray tube being disposed within the housing with the jet nozzles arranged to direct a generally planar stream of washing fluid at a roller disposed within the housing to clean and rotate the roller on its handle, a second end of the spray tube being fluidly connected by a fluid line to an external pressurized source of washing fluid; and a cap for closing the top of the tubular housing and arranged to support the roller within the housing for washing, the cap having a center, a generally radially aligned laterally opening first slot extending substantially to the center of the cap to facilitate mounting of the roller applicator on the cap, with the U-shaped portion of the roller frame being saddled on the cap with the first leg of the U-shaped portion extending through the slot to support the roller within the housing for washing, wherein the cap further includes means for adjustably fixing the position of the roller frame with respect to the cap to position the roller in a predetermined alignment with the planar stream of the washing fluid, wherein the cap further includes a second laterally opening slot, opopsitely facing and diametrically aligned with the first slot, through which the second leg of the U-shaped portion of the roller frame extends, externally of the housing.

6. The device of claim 5 wherein the means for adjustably fixing includes a pair of spaced apart flanges carried on one side of the cap in alignment with the first and second diametrically aligned slots, which flanges are resiliently biased toward one another to grasp the second leg of the U-shaped portion therebetween.

7. The device of claim 6 further comprising a second pair of generally parallel flanges extending upward from the cap and straddling the diametrically aligned first and second slots to laterally support the base leg of the roller frame.

8. The device of claim 7 wherein the housing further includes a positioning notch defined by an upper edge of the wall of the housing, which is arranged to mate with a portion of the second flanges to fix the position of the cap and roller with respect to a flow direction of the fluid stream, so that the washing fluid strikes the roller at a predetermined angle with respect to an axis of rotation of the roller.

* * * * *

UNITED STATES PATENT AND TRADEMARK OFFICE

CERTIFICATE OF CORRECTION

PATENT NO. : 4,672,987

DATED : June 16, 1987

INVENTOR(S) : Lloyd W. Brandt

It is certified that error appears in the above-identified patent and that said Letters Patent is hereby corrected as shown below:

Column 8, line 18, delete "opopsitely" and insert --oppositely--.

Signed and Sealed this

Thirteenth Day of October, 1987

*Attest:*

DONALD J. QUIGG

*Attesting Officer*

*Commissioner of Patents and Trademarks*